US005368380A

United States Patent [19]

Mottmiller et al.

[11] Patent Number: 5,368,380

[45] Date of Patent: Nov. 29, 1994

[54] CABINET ASSEMBLY

[75] Inventors: Russell P. Mottmiller; Erik J. Skov, both of Wooster, Ohio

[73] Assignee: Rubbermaid Incorporated, Wooster, Ohio

[21] Appl. No.: 2,438

[22] Filed: Jan. 8, 1993

[51] Int. Cl.[5] ..... A47B 47/00; F16B 12/00

[52] U.S. Cl. ..... 312/263; 312/111; 312/406.2

[58] Field of Search ..... 312/257.1, 108, 401, 312/405, 406, 406.2, 263; 108/111; 211/187, 186

[56] References Cited

U.S. PATENT DOCUMENTS

| | | | |
|---|---|---|---|
| 3,982,801 | 9/1976 | Heidorn et al. | 708/147 |
| 4,753,048 | 6/1988 | Bockwinkel | 52/308 |
| 5,265,954 | 11/1993 | Keil | 312/405 |

*Primary Examiner*—Stephen C. Pellegrino

*Assistant Examiner*—Nancy Mulcare

*Attorney, Agent, or Firm*—Richard B. O'Planick; Lisa B. Riedesel

[57] ABSTRACT

A cabinet assembly (2) is disclosed comprising side panels (6,8), a rear panel (4), top and bottom panels (10, 12), and forward doors (14, 16). The rear panel has side and top edge flanges (24,26) which fit into slots (50,58) in the top and side panels. The rear and side panels have a vertical series of ledges (28,30,32, and 52,54,42) along an inward facing side, each ledge having two upwardly projecting dovetail projections (38,56). The top panel and bottom panel each have receptacles (60,80) formed in an underside thereof for receiving the dovetail projections of the rear and side panels. Ashelf (18) is provided for assembly to intermediate ledges of the cabinet, between the ledges and an associated retention flange (55). The doors assemble pivotally to forward outward extensions (66,74) of the top and bottom panels.

15 Claims, 12 Drawing Sheets

CABINET ASSEMBLY

BACKGROUND OF THE INVENTION

1. Field of the Invention

The subject invention relates generally to self-enclosed cabinets and, more specifically, to cabinets which are sold in a disassembler condition for assembly by the end user.

2. The Prior Art

Cabinet assemblies are well known consumer products. Typically, commercial cabinets are sold in the disassembled, or "knocked down" condition, for subsequent assembly by the end user. The cabinets comprise sidewalls, top and bottom panels, and a forward door, which are mutually secured together by various hardware sold with the assembly.

While the aforementioned cabinet assemblies are popular and are well accepted commercially, certain shortcomings attend their use. First, the cabinets require a substantial amount of assembly time and effort, frequently frustrating the end user. In addition, hardware with which to assemble the cabinets requires that the end user have certain tools, and hardware is an expensive component adding to the overall cost of the cabinet assembly.

A further shortcoming is that end users often lack the mechanical skill to assemble the cabinet properly, resulting in a cabinet which lacks its designed structural integrity. Lastly, conventional cabinet assembly panels are formed of relatively expensive material, such as wood or metal, which taken in conjunction with the expense of the assembly hardware, makes the resultant product expensive to the end purchaser.

Summary of the Present Invention

The present invention overcomes the above shortcomings found in currently available cabinet assemblies. The invention comprises side panels, a rearward panel, top and bottom panels, and forward doors which are composed of plastic material and which are assembled by hand without the requirement for tools or assembly hardware. The rearward panel has side and top edge flanges which fit into slots in the top and side panels. The rearward and side panels have mutually level horizontal ledges positioned to face inward, with each ledge having upwardly projecting dovetail shaped projections. The top panel has underside receptacles which receive the uppermost ledge projections of the rearward and side panels, and the bottom panel has underside receptacles which receive the lowermost ledge projections of the rearward and side panels, whereby assembling the body of the cabinet. The top and bottom panels are T-shaped at the forward ends, with edge projections extending outward over the lower forward sides of the side panels. The projections have sockets formed within remote ends thereof. The door components are formed to have pivot posts at upper and lower comers which reside pivotally in the projection sockets.

The side panels are each formed having a horizontal retention flange associated with and spaced above each intermediate ledge, and a shelf member is provided with the assembly having sides which reside between the retention flange and the ledge therebelow to restrict upward and downward movement of the shelf. The dovetail shape of the ledge projections and the corresponding receptacles in the shelf underside restrict the shelfs motion in the remaining two axis.

Accordingly, it is an objective of the present invention to provide a cabinet assembly which is capable of assembly by the end user without tools and which requires no assembly hardware.

It is a further objective of the invention to provide a cabinet assembly formed of inexpensive plastic component parts.

Yet a further objective of the present invention is to provide a cabinet assembly which is structurally rigid in the assembled state.

Another objective of the present invention is to provide a cabinet assembly comprising interfitting and interlocking component parts which can be assembled by one person.

These, and other objectives, which will be apparent to one skilled in the art, are achieved by a preferred embodiment which is described in detail below and which is illustrated by the accompanying drawings.

DESCRIPTION OF THE ACCOMPANYING DRAWINGS

DESCRIPTION OF THE PREFERRED EMBODIMENT

Figure 1:
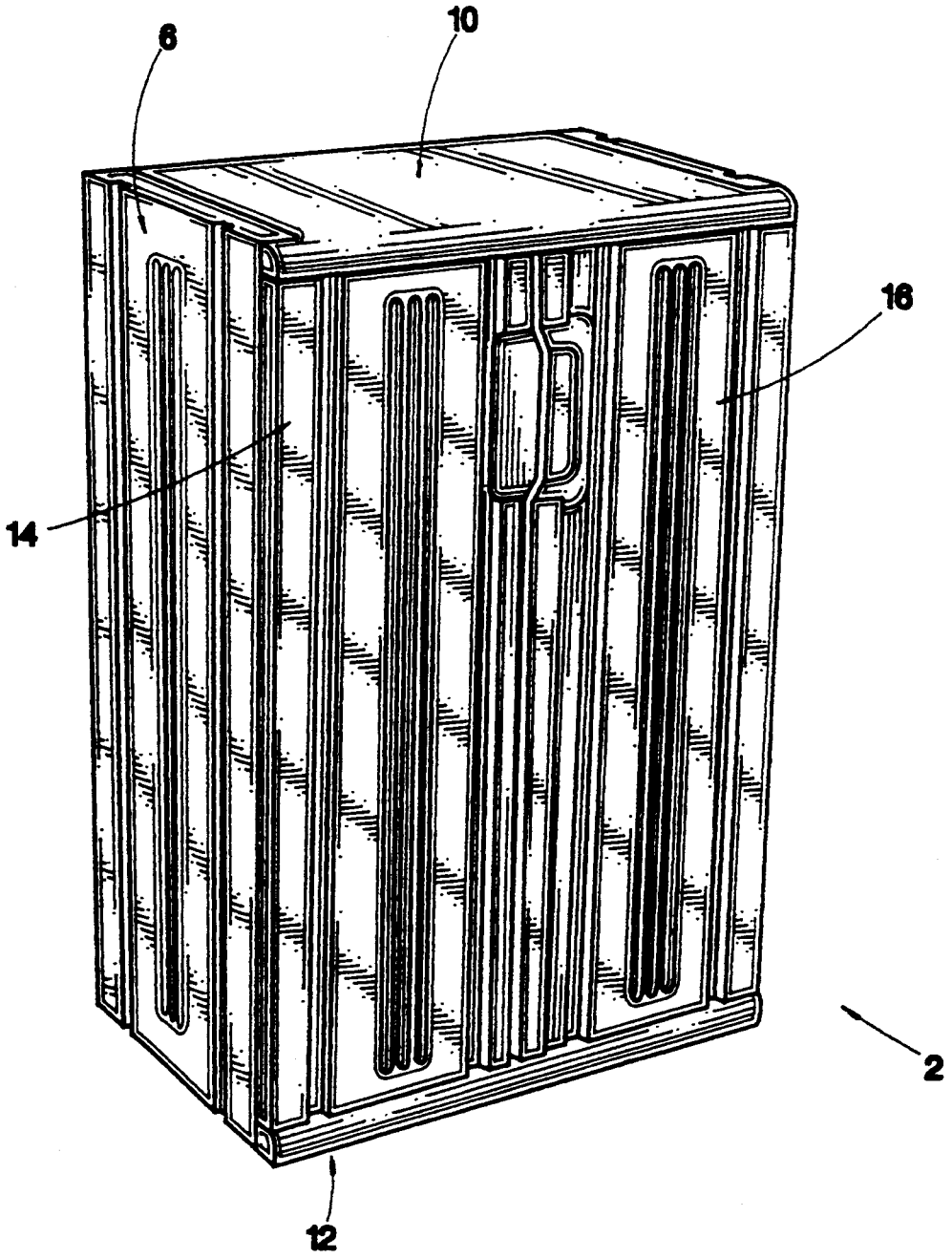
FIG. 1 is a front perspective view of the assembled cabinet.
Figure 2:
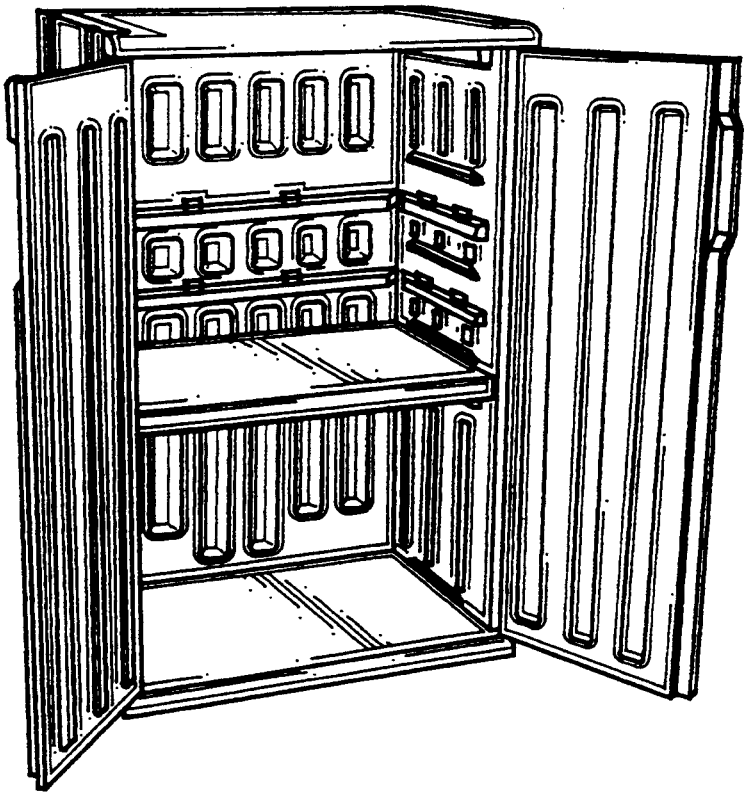
FIG. 2 is a front perspective view of the assembled cabinet with the doors shown in the open condition.

FIGS. 1 and 2 show the subject cabinet in the assembled condition, with the doors closed and open, respectively. The subject cabinet assembly 2 comprises a rearward panel 4, a pair of side panels 6,8, a top panel 10, a bottom panel 12, and a pair of door members 14, 16. The components are all molded of conventional plastic material such as high density polyethylene, and by conventional means.

Figure 3:
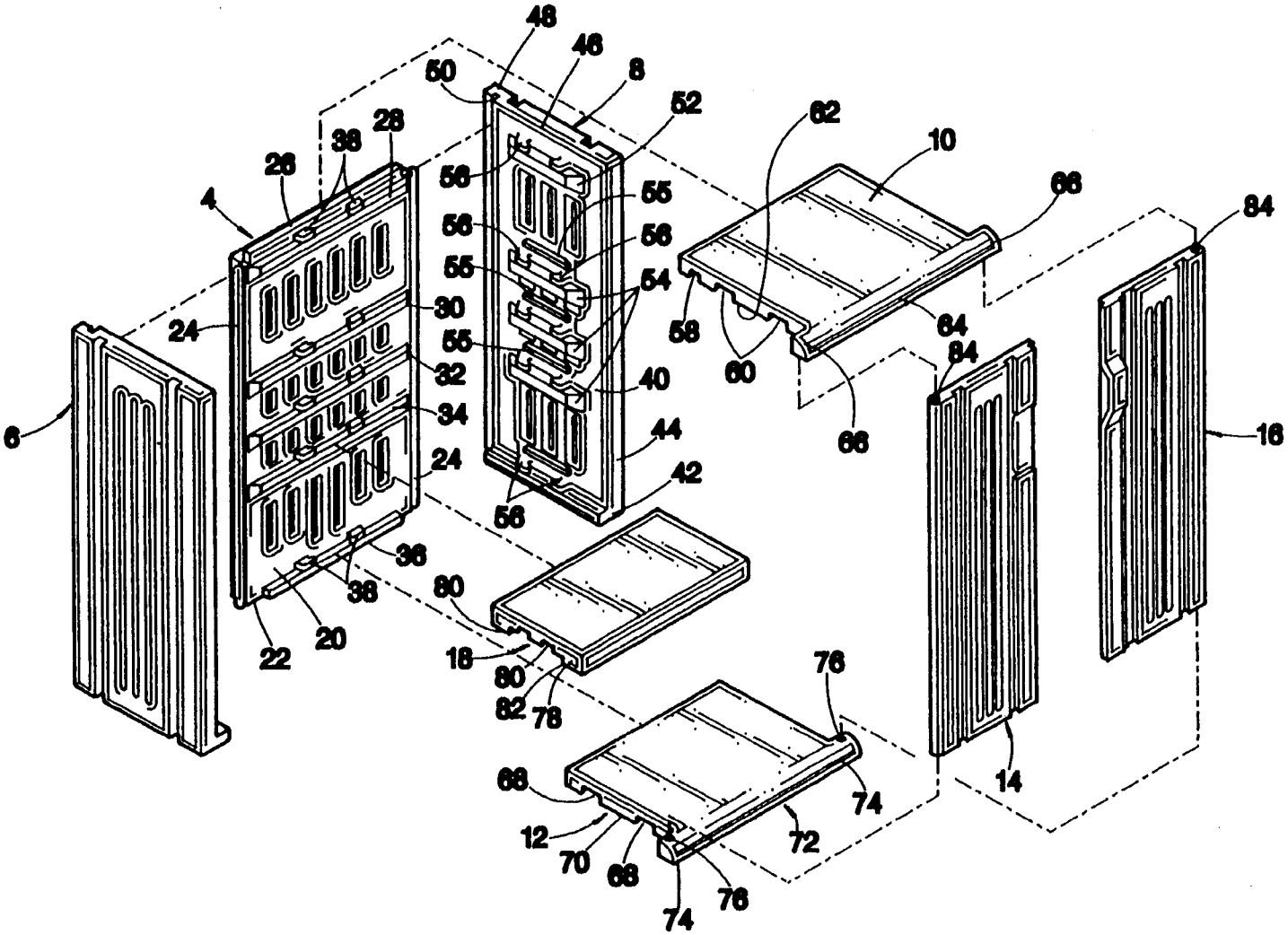
FIG. 3 is an exploded perspective view of the subject cabinet assembly.
Figure 4:
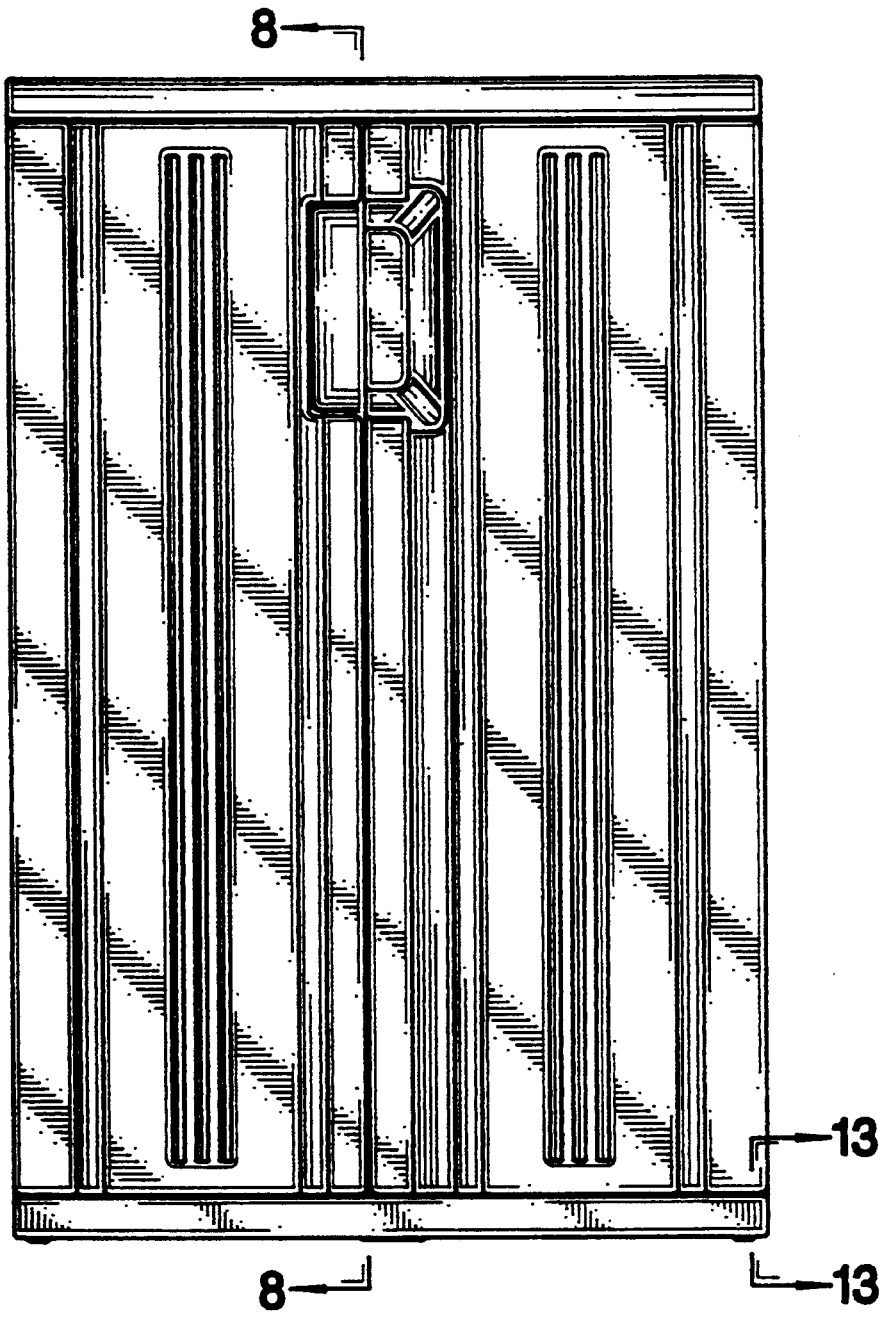
FIG. 4 is a front plan view of the subject cabinet.
Figure 5:
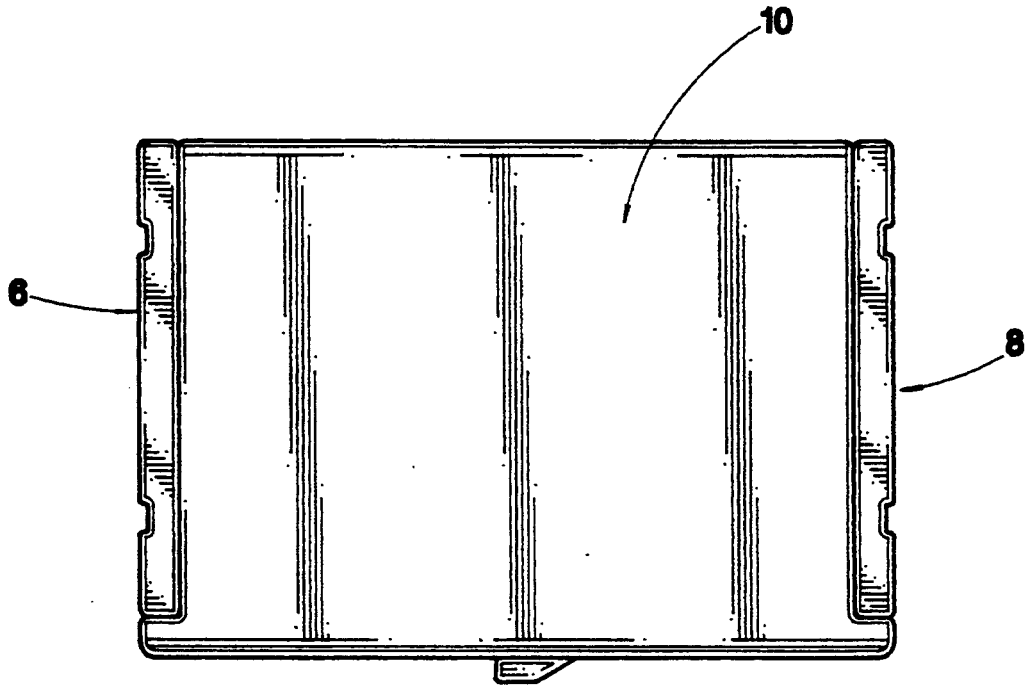
FIG. 5 is a top plan view thereof.
Figure 6:
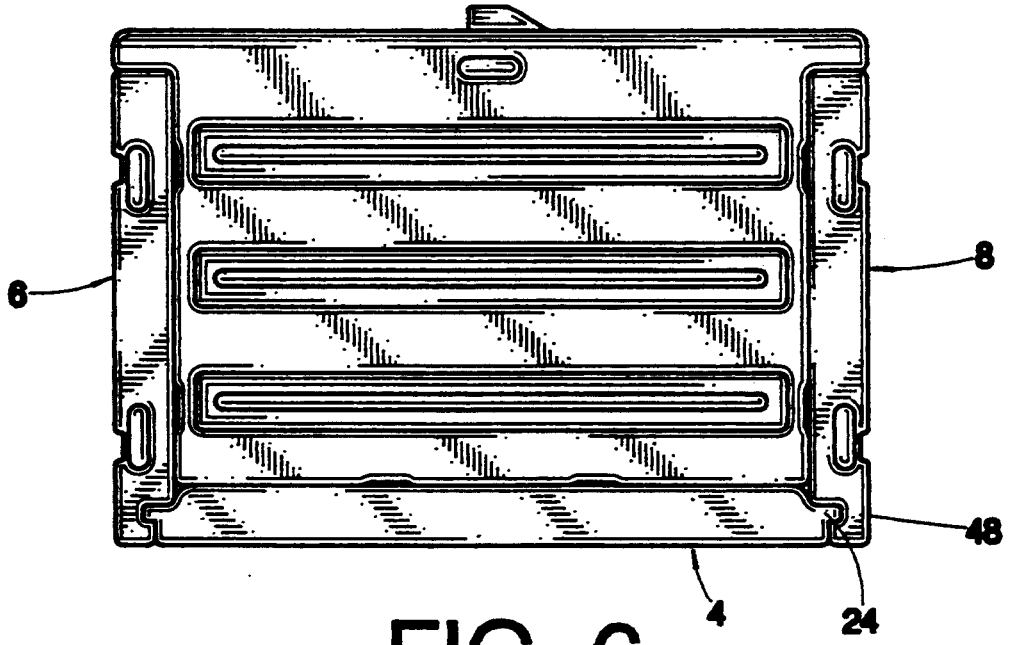
FIG. 6 is a bottom plan view thereof.

Referring to FIGS. 1,3, and 6, the assembly also comprises a plastic shelf 18 of generally rectangular shape. The rear panel 4 is of rectangular form and comprises a central body 20 having a fiat bottom 22. The long sides of the panel 4 each have an outwardly directed rectangular side flange 24 extending therealong, and the top side of the panel 4 has an upwardly directed rectangular top flange 26. An internal surface of the panel body 20 is provided with a series of horizontal ledges consisting of a top ledge 28, three intermediate ledges 30,32,34 and a bottom ledge 36. Each ledge has two dovetail-shaped projections 38 which are spaced apart and directed upwardly as shown.

Figure 10:
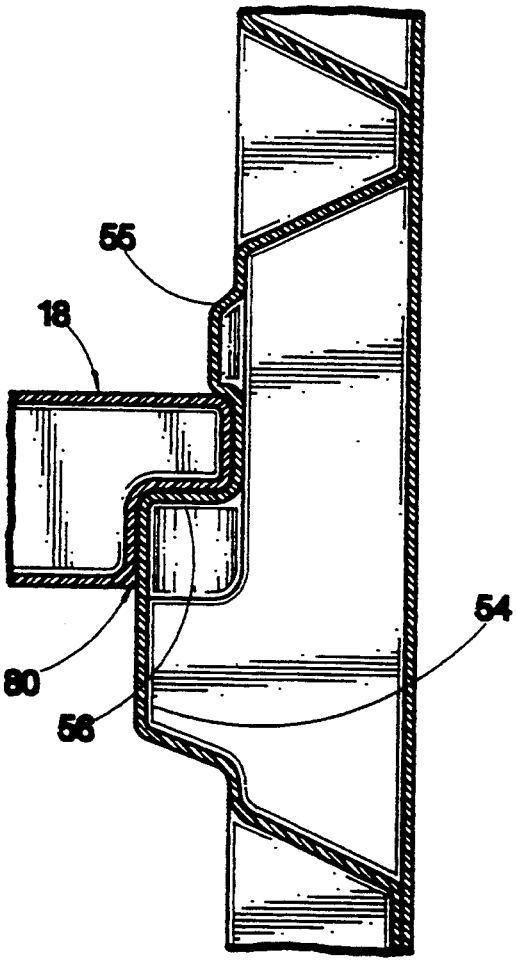
FIG. 10 is a partial section through the shelf and sidewall connection, taken along the line 10—10 of FIG. 8.

The side panels 6,8 each are of rectangular configuration comprising a central body 40 extending from a right angled, inwardly directed bottom flange 42 to an upper end 46. A forward side 44 of the panels is L-shaped, and a rearward side portion 48 is formed having a vertical groove or slot 50 formed therein. A series of ledges is likewise formed from an internally facing side of the body 40, comprising a horizontal top ledge 52 and three intermediate ledges 54. A pair of dovetail shaped protrusions 56 are provided each ledge, and project upward. A pair of spaced apart protrusions 56 is also provided on the top of the bottom flange 42 of the side panels as shown. Positioned above each of the intermediate ledges 54 is a horizontally disposed retention flange 55 which is parallel to and spaced above its associative ledge by a specific distance, as explained below. FIG. 10 illustrates the shape of a ledge and retention flange in cross-section.

The top panel 10 is illustrated as having a generally rectangular shape, and molded to provide spaced apart receptacles 60 at bottom side and rearward edge positions. The receptacles, it will be appreciated, have a shape and position to correspond with the protrusion 38 of the rear panel top ledge 28 and the side panel protrusions 56 of the top ledge 52. Also positioned within an underside of the top panel 10, along a rearward edge, is a slot or groove 58. The top panel groove 58 is dimensioned to receive the top flange 26 of the rear panel 4.

The lower edge 62 of the top panel I 0 is adapted to be positioned on the ledges 52, 28 of the side panels 6,8 and the rear panel 4, respectively. The top panel 10 extends forward to a radiussed, downturned rim flange 64 which has end protrusions 66 extending outward.

Figure 13:
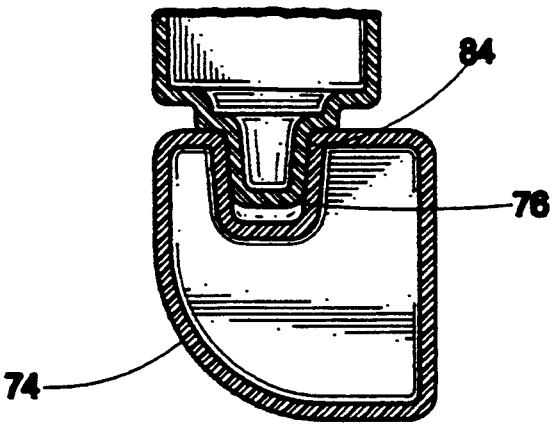
FIG. 13 is a partial section view of the door post to bottom panel connection taken along the line 13—13 of FIG. 4.

The bottom panel 12 has formed in opposite edge portions of the underside a pair of spaced apart receptacles 68 having a complimentary dovetail shape. The underside 70 of panel 12 is generally flat. The bottom panel terminates at a forward, radiussed, downturned rim 72 which, as with the top panel rim 64, has end protrusions 74 extending outwardly. A pivot socket 76 is provided each of the protrusions, extending downward into protrusions 74 and upward into protrusions 66. FIG. 13 illustrates the general profile of such sockets.

Continuing, with respect to FIGS. 1, 3, and 6, the shelf 18 has downturned sides 78 and dovetail-shaped receptacles 80 extend into the underside 82 of the shelf, located and sized to receive the ledge protrusions 38, 56 of the rear panel and side panel intermediate ledges. The shelf drops downward onto the ledges as the receptacles 80 receive the ledge protrusions, and the shelf is repositonable to any of the three intermediate ledge elevations.

The two door panels 14, 16 have at their outer corners an upwardly extending and a downwardly extending pivot pin 84 integrally molded with the panels, and sized and positioned to enter the sockets 76 of the top and bottom panels as shown by FIG. 13.

Figure 7:
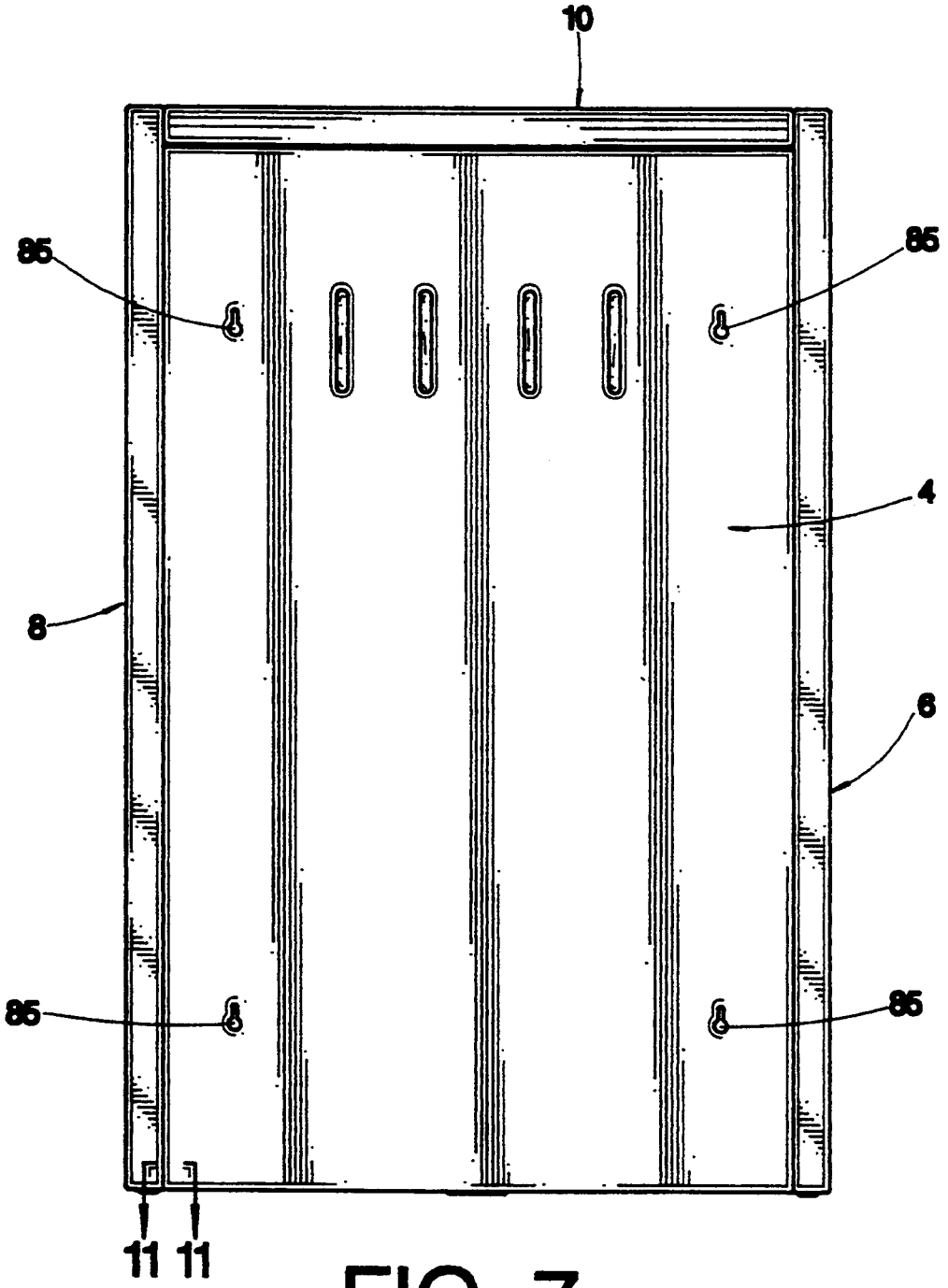
FIG. 7 is a rear plan view thereof.
Figure 8:
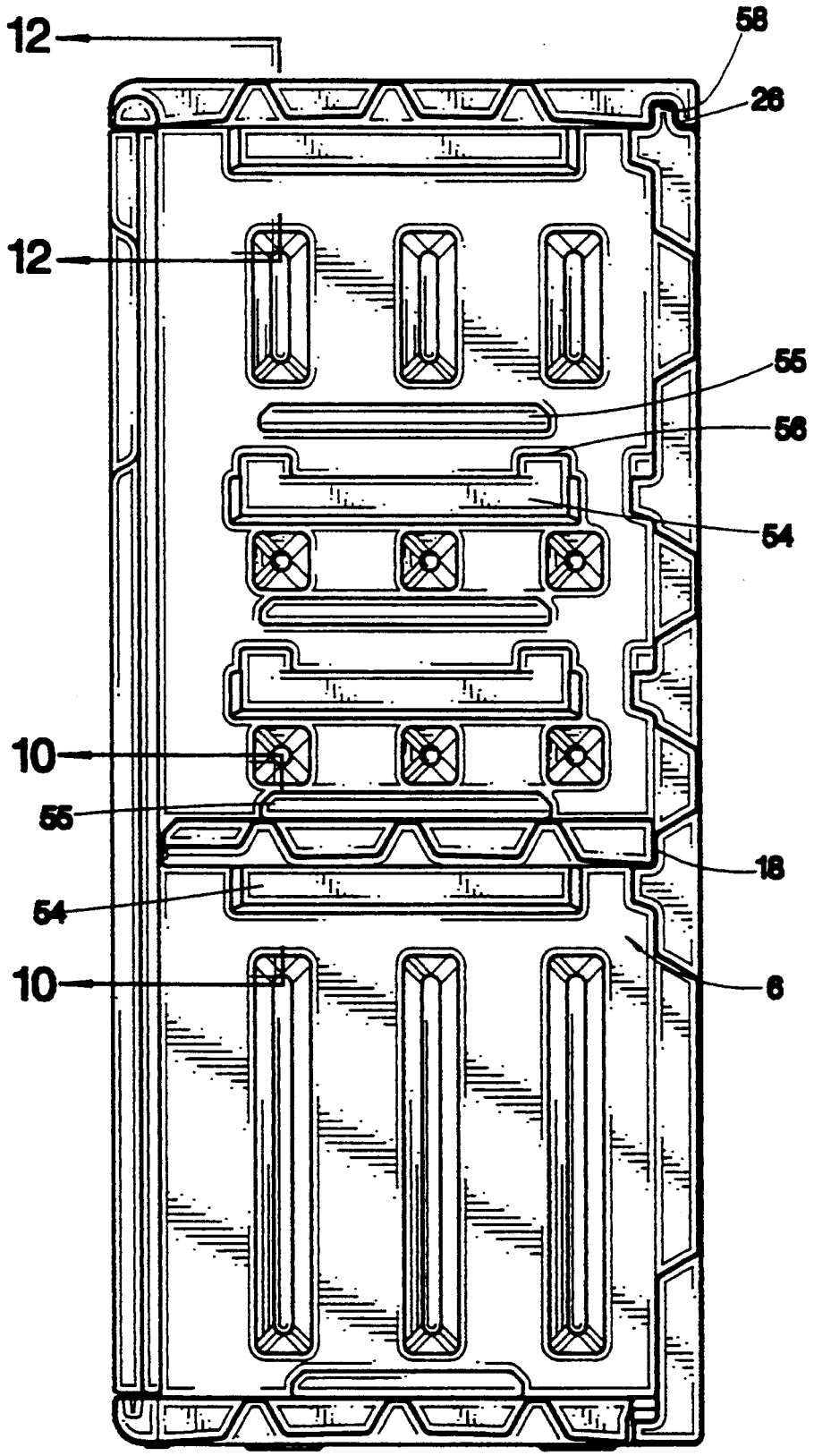
FIG. 8 is a longitudinal cross-section view through the assembled cabinet taken along the line 8—8 of FIG. 4.
Figure 9:
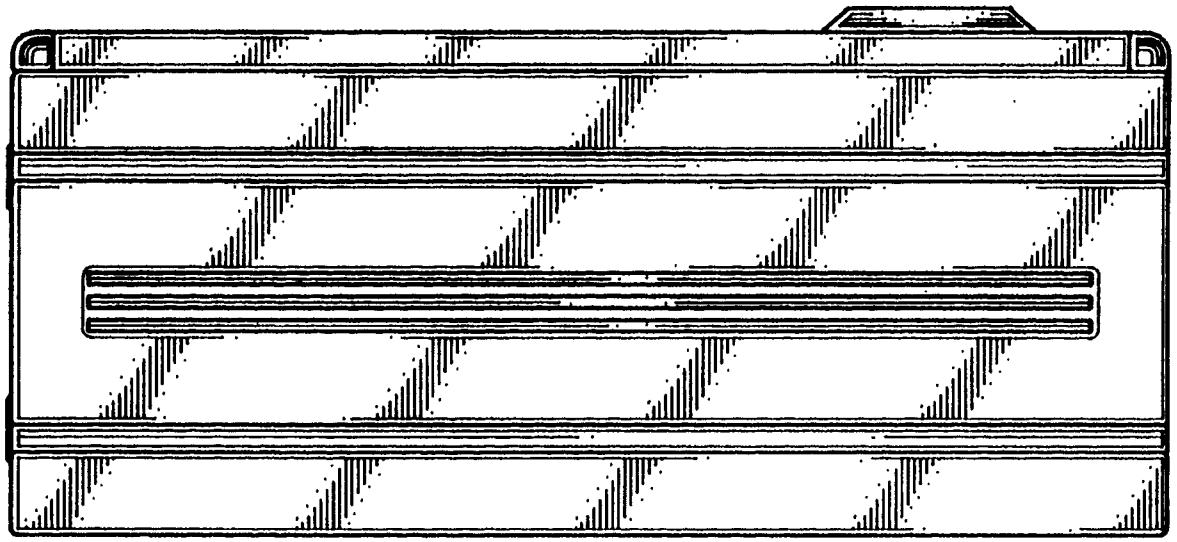
FIG. 9 is a side elevation view of the assembled cabinet.

Referring to FIG. 7, the rear panel 4 has four through apertures 85 which facilitate the hanging of the subject cabinet from a vertical wall. Alternatively, the cabinet is intended to be free standing when assembled and can be positioned on a floor.

Figure 11:
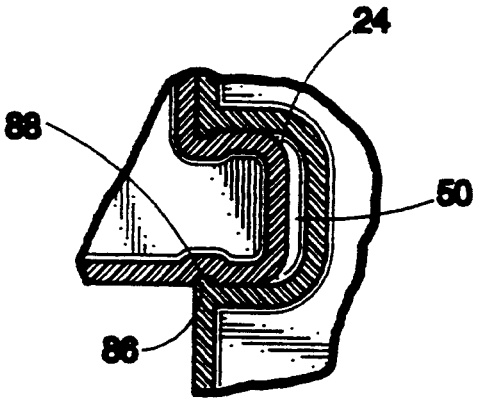
FIG. 11 is a partial section view of the rear panel to side panel connection taken along the line 11—11 of FIG. 7.
Figure 12:
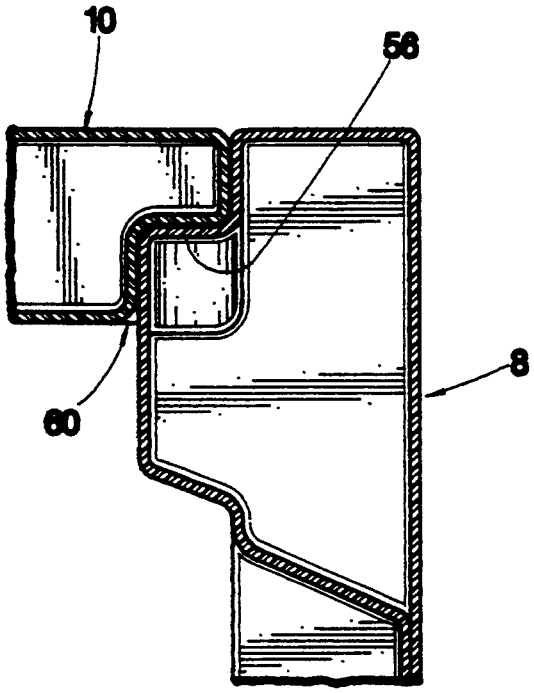
FIG. 12 is a partial section view of the top panel to side panel connection taken along the line 12—12 of FIG. 8.

Assembly of the subject cabinet proceeds as follows. The rear and side panels, 4,6, and 8 are attached by the entry of side flanges 24 of the rear panel 4 into the vertical edge grooves 50 of the side panels 6,8. FIG. 11 illustrates that the grooves 50 are formed to have an inwardly projecting shoulder 86 which enters into a corresponding indentation 86 in the side flanges 24 to retain the panels together.

The elastomeric properties of the molded panels facilitate the entry of the flanges into the grooves, over the shoulders 86.

Subsequently, the door panels 16, and top and bottom panels 10, 12 are assembled to the rear and side panels. The door panel pivot pins 84 are captured by the sockets 76 of the top and bottom panels (FIG. 13) as the top flange 26 of the rear panel 4 enters the slot 58 of the top panel 10. The bottom panel 12 overlies the bottom ledge 36 and bottom flanges 42 of the rear panel and side panels, respectively, as receptacles 68 along the sides and back of the bottom panel 12 receive the protrusions 38, 56. The bottom panel passes with interference the retention flanges 55 above the side panel bottom flanges 42 and, once clear, the retention flanges 55 keep the bottom panel from moving upward.

The shelf 18 is positioned at one of the several locations afforded by the intermediate ledges of the side and rear panels, as will be appreciated by FIG. 2. The shelf is seated by a downward movement toward the ledges selected, and passes with interference over the retention flanges 55 of the side panels, which are located above such ledges. Upon clearing the retention flanges, the dovetail protrusions 38 and 56 of the rear panel and side panel intermediate ledges enter into the dovetail-shaped receptacles 80 of the shelf and the shelf is held in such position by the retention flanges 55. FIG. 10 illustrates the position of the shelf 18 between the retention flange 55 and the ledge 54. Release of the shelf, for repositionment to another level, is accomplished by an upward force on the shelf sufficient to overcome the retention flange 55. The resilient elastomeric properties of the panels and shelf facilitate the retention and release procedure as intended.

Figure 14:
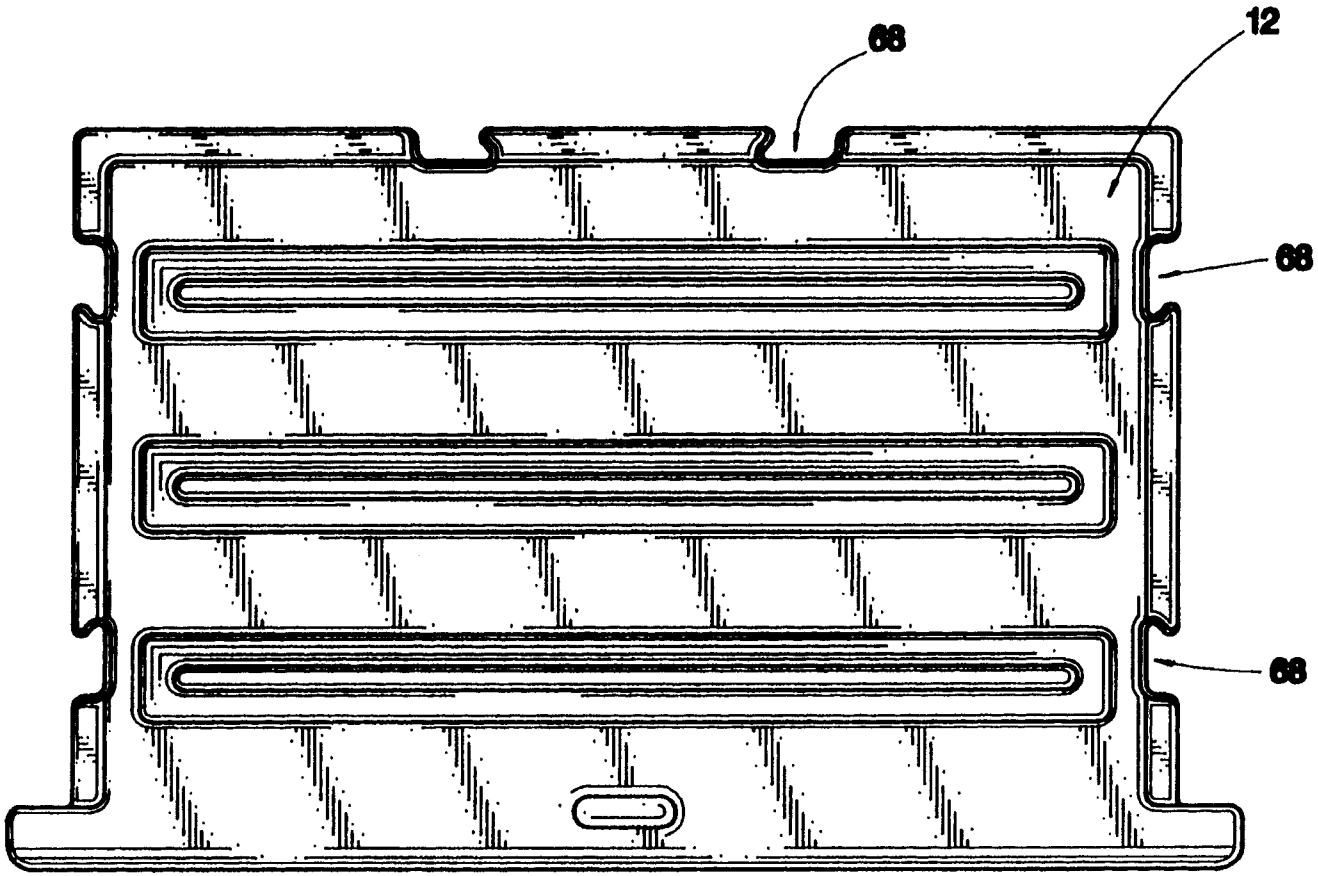
FIG. 14 is a bottom plan view of the bottom panel.
Figure 15:
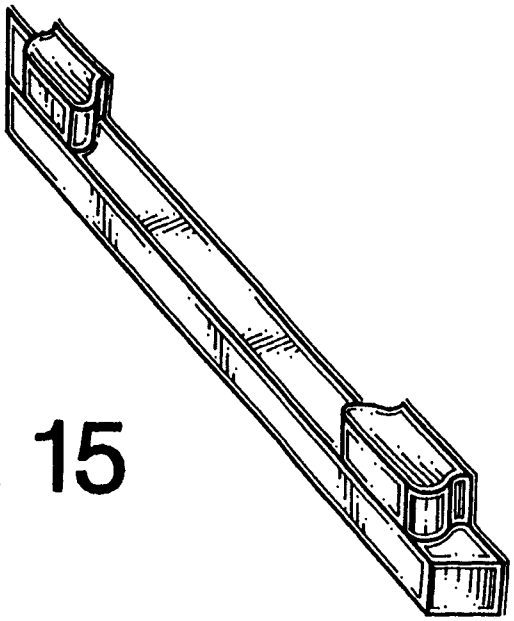
FIG. 15 is a perspective view of a side panel ledge showing the configuration of the dovetail projections thereof.

FIG. 14 illustrates the receptacle 68 configuration in the edges of the bottom panel 12. Considered in conjunction with FIG. 15, which shows the dovetail shape of the protrusions, it will be apparent that once the protrusions are within the receptacles, movement between the parts is prohibited in two directions, while upward and downward movement is prohibited by the retention flanges 55. Thus, the bottom panel and the shelf are secured to the assembly and held immovable in all three axis.

It will be appreciated that the subject assembly is comprised of all plastic component pans, which can be conventionally molded of available plastic by known processes. Further, such components can be readily assembled without the need for hand tools, by the end user. Consequently, the assembly may be sold in the knocked down state, for subsequent assembly by the user, saving display space at retail stores and the cost of transportation of the assembly. Finally, the assembly consists of only eight parts, and require no assembly hardware, making the product cost effective, yet the resultant assembly is strong and versatile. The shelf is repositonable to three levels in the cabinet, and the dual pivoting doors afford convenience to the end user. Lastly, the plastic construction makes the assembly relatively light weight and makes the wall suspension of the cabinet practical and easy for the end user.

While the above describes the preferred embodiment of the subject invention, the invention is not intended to be so restricted. Other embodiments, which will be apparent to one skilled in the art, and which utilize the teachings herein set forth, are intended to be within the scope and spirit of the invention.

We claim:

1. A cabinet assembly comprising:

a rearward panel having a top edge, a bottom edge and first and second opposite side edges;

first and second opposed side panels, each said side panel having means for attachment to the opposite side edges of the rearward panel;

a top panel and a bottom panel each having means for attachment to the top edge and the bottom edge of the rearward panel, respectively;

the top and bottom panels having means for attachment to a top edge and a bottom edge of the side panels and having a T-shape at a forward end comprising outwardly extending first and second edge protrusions positioned to overlap upper and lower frontal edge portions, respectively, of each of the side panels, and at least one of the edge protrusions of the top and the bottom panels having a sized aperture extending therein; and at least one door having a top and a bottom corner pivotally attached to a forward side of the assembly and comprising an upper and a lower pivot post projecting from the top and the bottom door corners, respectively, and residing in the top and the bottom sized apertures in the top and bottom panel edge protrusions.

2. A cabinet assembly according to claim 1, wherein the rearward panel side edges each having an outwardly projecting and vertically oriented side edge flange and the first and second side panels each having a rearwardly disposed and inwardly facing groove for receiving a respective one of the rearward panel side edge flanges.

3. A cabinet assembly according to claim 2, wherein the rearward panel having an upwardly projecting and horizontally oriented top edge flange and the top panel having a rearwardly disposed and downwardly facing groove for receiving the rearward panel top edge flange.

4. A cabinet assembly according to claim 3, wherein the rearward and side panels having at least one mutually level and horizontally disposed ledge positioned to face inward, the ledge having at least one upwardly directed profiled projection, and the assembly further comprising a shelf having sides dimensioned for close receipt between the cabinet door and cabinet side and rearward panels, the shelf further comprising a lower side edge positioned for placement upon the rearward and side panel ledges, and recesses in a lower surface profiled for receipt of the ledge projections.

5. A cabinet according to claim 4, wherein each of the side panels having a horizontally disposed retention flange spaced above the ledge and the shelf side is positionable between the retention flange and the ledge to restrict upward movement of the shelf.

6. A cabinet according to claim 5, wherein the rearward and side panels having mutually level and horizontally disposed ledges at top and bottom ends and positioned to face inward, the ledges each having at least one upwardly directed profiled projection, and the top and bottom panels each having a lower side edge positioned for placement upon the rearward and side panel top and bottom ledges, respectively, and recesses in a lower surface profiled for receipt of the top and bottom ledge projections.

7. A cabinet assembly according to claim 6, wherein the ledge projections having a dovetail shape.

8. A cabinet assembly according to claim 7, wherein the recesses having a dovetail shape of mirror image to the ledge projection shape.

9. A cabinet assembly comprising:

a rearward panel having a top edge, a bottom edge and first and second opposite side edges;

first and second opposed side panels, each said side panel having means for attachment to the opposite side edges of the rearward panel;

a top panel and a bottom panel for assembly to the top and the bottom edges of the rearward panel, respectively;

the rearward and the side panels having at least one horizontally disposed ledge lying in a common plane proximate a top end, with the ledges positioned to face inward;

at least one upwardly directed projection positioned upon one of the ledges; and the top panel having a plurality of lower side edges positioned for placement upon the rearward and the side panel ledges and at least one recess in a lower surface shaped for receipt of the ledge projection.

10. A cabinet assembly according to claim 9, wherein the ledge projection having a dovetail shape and the top panel recess having a dovetail shape of mirror image to the ledge projection shape.

11. A cabinet assembly according to claim 10, wherein the top and bottom panels having means for attachment to top and bottom edges of the side panels, respectively, and each having a T-shape at a forward end comprising outwardly extending first and second edge protrusions positioned to overlay upper and lower frontal edge portions of the side panels, and at least one of the edge protrusions of each the top and the bottom panels having a sized aperture extending therein; and the assembly further comprising:

at least one door having an upper and a lower corner pivotally attached to a forward side of the assembly and having an upper and a lower pivot post projecting from the upper and the lower door corners, respectively, and residing in the top and the bottom sized apertures in the top and bottom panel edge protrusions.

12. A cabinet assembly according to claim 11, wherein the rearward panel having outwardly projecting and vertically oriented side edge flanges and the first and second side panels have a rearwardly disposed and inwardly facing groove for receiving the rearward panel side edge flanges.

13. A cabinet assembly according to claim 12, wherein the rearward panel having an upwardly projecting and horizontally oriented top edge flange and the top panel having a rearwardly disposed and downwardly facing groove for receiving the rearward panel top edge flange.

14. A cabinet assembly according to claim 13, wherein the rearward and side panels having at least one intermediately positioned and horizontally extending shelf ledge lying in a common plane and facing inward, each said ledge having at least one upwardly directed profiled projection, and the assembly further comprising a shelf having sides dimensioned for close receipt between the cabinet door and cabinet side and rearward panels, the shelf further comprising a lower side edge positioned for placement upon the rearward and side panel intermediate ledges and recesses in a lower surface profiled for receipt of the ledge projections.

15. A cabinet assembly according to claim 14, wherein each side panel having a horizontally disposed retention flange spaced above the ledge and facing inward, and the shelf side is positionable between the retention flange and the ledge to restrict upward movement of the shelf.

* * * * *

UNITED STATES PATENT AND TRADEMARK OFFICE

CERTIFICATE OF CORRECTION

PATENT NO. : 5,368,380

DATED : November 29, 1994

INVENTOR(S) : Russell P. Mottmiller, Erik J. Skov

It is certified that error appears in the above-identified patent and that said Letters Patent is hereby corrected as shown below:

On the title page, item [56] Add the following citations:

U. S. PATENT DOCUMENTS

| | | | |
|---|---|---|---|
| 1,859,798 | 5/1932 | Rix | |
| 3,307,505 | 3/1967 | Windross | 108/111 |
| 3,353,888 | 11/1967 | Pritelli | 312/257 |
| 3,669,033 | 6/1972 | Murcia | 108/111 |
| 3,964,810 | 6/1976 | Murphy | 312/257 |
| 4,145,977 | 3/1979 | Yellin | 108/111 |
| 4,474,416 | 10/1984 | Rogahn | 312/257 |
| 4,519,511 | 5/1985 | Mendenhall | 211/187 |
| 4,691,644 | 9/1987 | Frydman | 108/111 |
| 4,706,576 | 11/1987 | James | 108/111 |
| 4,786,122 | 11/1988 | Nichoalds | 312/257 |
| 5,158,187 | 10/1992 | Taub | 211/186 |

OTHER PUBLICATIONS

Catalog page, Cabinet; Gusdorf, address unknown. It is believed that the product depicted herein has been on sale for more than one (1) year prior to the application date of this instant application.

Catalog page, Cabinets; Potomac Engineering Corp., 919 North Michigan Ave., Chicago, IL 60611. Publication date 1991.

Sell sheet, Cabinets; P. I. Industries, Vista, California. It is believed that the product depicted herein has been on sale for more than one (1) year prior to the application date of this instant application.

Sell sheet, Cabinets; P. I. Industries, Vista, California. It is believed that the product depicted herein has been on sale for more than one (1) year prior to the application date of this instant application.

UNITED STATES PATENT AND TRADEMARK OFFICE

CERTIFICATE OF CORRECTION

PATENT NO. : 5,368,380

DATED : November 29, 1994

INVENTOR(S) : Russell P. Mottmiller, Erik J. Skov

It is certified that error appears in the above-indentified patent and that said Letters Patent is hereby corrected as shown below:

Sell sheet, Cabinets; P. I. Industries, Vista, California. It is believed that the product depicted herein has been on sale for more than one (1) year prior to the application date of this instant application.
Catalog page, Cabinets; Edsal, Cabinette, Address unknown. It is believed that the product depicted herein has been on sale for more than one (1) year prior to the application date of this instant application.
Catalog page, Cabinets; Hirsh, 8051 Central Park Ave., Skokie, IL 60076. Publication date 1989.
Page 18, Dabinets; The Little Tikes Company, 2180 Barlow Road, Hudson, OH 44236. Publication date 1986.

Signed and Sealed this

Thirty-first Day of October 1995

*Attest:*

Bruce Lehman

BRUCE LEHMAN

*Attesting Officer*

*Commissioner of Patents and Trademarks*